US006082846A

United States Patent [19]

Terasawa et al.

[11] Patent Number: 6,082,846

[45] **Date of Patent: *Jul. 4, 2000**

[54] INK JET RECORDING WITH RECOVERY OPERATION AND ASSOCIATED TEST PRINTING

[75] Inventors: Koji Terasawa, Mitaka; Akira Miyakawa, Tanashi; Hideki Yamaguchi, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/340,475

[22] Filed: Nov. 14, 1994

Related U.S. Application Data

[60] Continuation of application No. 07/994,523, Dec. 21, 1992, abandoned, which is a division of application No. 07/834,999, Feb. 14, 1992, Pat. No. 5,202,702, which is a continuation of application No. 07/746,214, Aug. 16, 1991, abandoned, which is a continuation of application No. 07/598,778, Oct. 18, 1990, abandoned, which is a continuation of application No. 07/449,411, Dec. 18, 1989, abandoned, which is a continuation of application No. 07/267,632, Oct. 31, 1988, abandoned, which is a continuation of application No. 06/846,887, Apr. 1, 1986, abandoned.

[30] Foreign Application Priority Data

| | | | |
|---|---|---|---|
| Apr. 8, 1985 | [JP] | Japan | 60-074091 |
| Apr. 8, 1985 | [JP] | Japan | 60-074092 |
| Apr. 8, 1985 | [JP] | Japan | 60-074093 |
| Apr. 8, 1985 | [JP] | Japan | 60-074094 |
| Apr. 8, 1985 | [JP] | Japan | 60-074095 |
| Apr. 8, 1985 | [JP] | Japan | 60-074096 |

[51] Int. Cl.[7] ..... B41J 29/393

[52] U.S. Cl. ..... 347/19

[58] Field of Search ..... 347/19, 29, 30, 347/31, 32, 23, 17, 35, 60

[56] References Cited

U.S. PATENT DOCUMENTS

| | | | |
|---|---|---|---|
| 4,030,588 | 6/1977 | Hanagata | 347/33 X |
| 4,112,435 | 9/1978 | Kattner et al. | 346/140 R |
| 4,144,537 | 3/1979 | Kimura | 347/31 |
| 4,306,245 | 12/1981 | Kasugayama et al. | 346/140 R |
| 4,313,684 | 2/1982 | Tazaki | 347/37 X |
| 4,364,065 | 12/1982 | Yamamori et al. | 346/140 R |
| 4,371,881 | 2/1983 | Bork | 347/33 |
| 4,394,669 | 7/1983 | Ozawa | 347/30 X |
| 4,436,439 | 3/1984 | Koto | 400/126 |
| 4,437,105 | 3/1984 | Mrazek | 347/33 X |
| 4,490,728 | 12/1984 | Vaught | 347/60 |
| 4,493,993 | 1/1985 | Kanamuller | 347/19 X |
| 4,543,589 | 9/1985 | Terasawa | 346/140 R |

(List continued on next page.)

FOREIGN PATENT DOCUMENTS

| | | | |
|---|---|---|---|
| 0110634 | 6/1984 | European Pat. Off. | B41J 3/04 |
| 26 07 313 | 9/1977 | Germany . | |
| 2746617 | 4/1979 | Germany | B41J 3/04 |
| 3316968 | 11/1983 | Germany | B41J 3/04 |
| 3246707 | 6/1984 | Germany | B41J 3/04 |
| 3417886 | 11/1984 | Germany | B41J 3/04 |

(List continued on next page.)

*Primary Examiner*—John Barlow
*Assistant Examiner*—Juanita Stephens
*Attorney, Agent, or Firm*—Fitzpatrick, Cella, Harper & Scinto

[57] ABSTRACT

A system using an ink jet recording head for scanning between a recording area and a non-recording area and for discharging ink to record an image on a recording medium at the recording area. The system includes wiping a discharge surface of the ink jet recording head, preliminarily discharging ink from the recording head after wiping, and performing normal recording in response to a recording signal without wiping the discharge surface of the ink jet recording head after the preliminary discharge.

10 Claims, 4 Drawing Sheets

U.S. PATENT DOCUMENTS

| | | | |
|---|---|---|---|
| 4,551,735 | 11/1985 | Suzuki | 347/30 |
| 4,577,203 | 3/1986 | Kawamura | 347/30 |
| 4,600,931 | 7/1986 | Terasawa | 346/140 R |
| 4,609,925 | 9/1986 | Nozu | 347/17 X |
| 4,668,965 | 5/1987 | Tanaka | 347/26 |
| 4,675,696 | 6/1987 | Suzuki | 347/19 X |
| 4,682,184 | 7/1987 | Terasawa | 347/30 |
| 4,695,855 | 9/1987 | Ichihashi et al. | 346/145 |
| 4,719,472 | 1/1988 | Arakawa | 347/17 X |
| 4,723,129 | 2/1988 | Endo | 347/56 |
| 4,728,970 | 3/1988 | Terasawa | 347/30 |
| 4,737,801 | 4/1988 | Ichihashi et al. | 347/85 |
| 4,748,459 | 5/1988 | Ichihashi et al. | 347/31 |
| 4,819,012 | 4/1989 | Kiyohara et al. | 347/30 |
| 4,977,459 | 12/1990 | Ebinuma et al. | 358/296 |
| 4,999,643 | 3/1991 | Terasawa | 347/30 |
| 5,086,305 | 2/1992 | Terasawa | 347/30 |
| 5,140,429 | 8/1992 | Ebinuma et al. | 358/296 |
| 5,182,582 | 1/1993 | Okamura | 347/33 |
| 5,353,052 | 10/1994 | Suzuki et al. | 347/19 |

FOREIGN PATENT DOCUMENTS

| | | | |
|---|---|---|---|
| 56-46767 | 4/1981 | Japan | B41J 3/04 |
| 57-83458 | 5/1982 | Japan | B41J 3/04 |
| 58-94472 | 6/1983 | Japan | B41J 3/04 |
| 58-128034 | 8/1983 | Japan | B41J 3/04 |
| 59-045162 | 3/1984 | Japan | B41J 3/04 |
| 59-45161 | 3/1984 | Japan | B41J 3/04 |
| 59-190859 | 10/1984 | Japan | B41J 3/04 |
| 60-88744 | 6/1985 | Japan | B41J 3/04 |
| 60-114737 | 8/1985 | Japan | B41J 3/04 |
| 60-114738 | 8/1985 | Japan | B41J 3/04 |
| 2112715 | 7/1983 | United Kingdom | B41J 3/04 |

INK JET RECORDING WITH RECOVERY OPERATION AND ASSOCIATED TEST PRINTING

This application is a division of application Ser. No. 07/994,523 filed Dec. 21, 1992, now abandoned, which in turn is a division of application Ser. No. 07/834,999 filed Feb. 14, 1992, now U.S. Pat. No. 5,202,702, which in turn is a continuation of application Ser. No. 07/746,214 filed Aug. 16, 1991, now abandoned, which in turn is a continuation of application Ser. No. 07/598,778 filed Oct. 18, 1990, now abandoned, which in turn is a continuation of application Ser. No. 07/449,411 filed Dec. 18, 1989, now abandoned, which in turn is a continuation of application Ser. No. 07/267,632 filed Oct. 31, 1988, now abandoned, which in turn is a continuation of application Ser. No. 06/846,887 filed Apr. 1, 1986 now abandoned. SPECIFICATION TO ALL WHOM IT MAY CONCERN:

Be it known that we, KOJI TERASAWA, AKIRA MIYAKAWA and HIDEKI YAMAGUCHI, subjects of Japan, residing at 9-5-103, Shimorenjaku 9-chome, Mitaka-shi, Tokyo, Japan, 2-10, Shibakubo 2-chome, Tanashi-shi, Tokyo, Japan and 33-7, Aobadai 2-chome, Midori-ku, Yokohama-shi, Kanagawa-ken, Japan, have jointly invented a certain new and useful improvement in AN INK JET RECORDING APPARATUS AND A METHOD OF CLEANING A RECORDING HEAD USED IN THE APPARATUS of which the following is a full, clear, concise and exact description.

BACKGROUND OF THE INVENTION

1. Field of the Invention

This invention relates to an ink jet recording apparatus having a cleaning mechanism for cleaning a surface in which an ink discharge port is provided (the front surface of a recording head) and to a method of cleaning the recording head used in the apparatus.

2. Related Background Art

In ink jet recording apparatuses, paper powder, dust or ink of increased viscosity may adhere to a surface in which is provided the ink discharge port of a recording head installed on a carriage movable along recording paper, and the ink discharge port may be clogged thereby causing unsatisfactory ink discharge. Heretofore, it has been practised to provide cleaning means in order to remove these foreign materials.

A mechanism for wiping the ink discharge port surface of the recording head by a flexible blade may be adopted as such cleaning means.

Also, in ink jet recording apparatuses, in order to prevent the ink discharge port from being clogged by ink of increased viscosity resulting from evaporation of ink solvent, or adherence of dust, or bubbles caused by gases remaining after solution, capping means for capping the ink discharge port surface of the recording head and ink discharge recovery means for effecting idle discharge of ink may be adopted. The capping operation and the ink discharge recovery operation by these means, respectively, are usually performed when the carriage mounting the recording head thereon is in its home position.

However, in the ink jet recording apparatus according to the prior art, the operation of cleaning said ink discharge port surface is independent of said capping operation and said ink discharge recovery operation and thus, requires a drive source exclusively for cleaning and is performed in a discrete sequence, and this has led to structural complexity and increased cost.

Also, even in a case where a mechanism for wiping the front surface of the recording head by a flexible blade made of a plastic sheet or the like is adopted as cleaning means, the cleaning operation by said blade is performed as an independent operation and an exclusive drive source (motor) is required for the driving of the blade, and this has also led to structural complexity and bulkiness as well as increased cost.

SUMMARY OF THE INVENTION

It is an object of the present invention to provide an ink jet recording apparatus which solves the above-noted problems peculiar to the prior art.

It is another object of the present invention to provide an ink jet recording apparatus which does not require a drive source for exclusive use and in which the front surface of the recording head, i.e., the ink discharge port surface, can be wiped by a minimum mechanism.

In accordance with one aspect of the invention, an ink jet apparatus comprises a recovery device for performing a recovery operation on an ink jet head to recover a discharge condition thereof and a test print mechanism for conducting a test print using the ink jet head.

In accordance with another aspect of the invention, a recording method for an ink jet apparatus comprises the steps of performing a recovery operation on an ink jet head to recovery a discharge condition thereof and conducting a test print using the ink jet head.

It is a further object of the present invention to provide an ink jet recording apparatus and a cleaning method which do not require any new cleaning mechanism and any special sequence or the like and in which the ink discharge port surface can be wiped always by a clean blade.

It is still a further object of the present invention to provide an ink jet recording apparatus and a cleaning method in which the direction of wiping by the blade is set to one direction, whereby dust is not forced into the ink discharge ports and cleaning of the ink discharge port surface can be accomplished reliably.

It is also an object of the present invention to provide a method of cleaning an ink jet recording head characterized in that a flexible blade is moved forwardly and backwardly in response to the capping operation of the front surface of the recording head and the movement of a carriage and the front surface of the recording head is wiped by said blade in response to the movement of said carriage.

It is another object of the present invention to provide an ink jet recording apparatus having a recording head disposed on a carriage, cap means for covering the front surface of said recording head and a blade for cleaning the front surface of said recording head, and further having blade moving means for moving said blade forward or backward in the direction of said recording head in response to the movement of said cap means and the movement of said carriage.

It is still another object of the present invention to provide a method of cleaning an ink jet recording head wherein when the front surface of said recording head is wiped by a flexible blade with the aid of the movement of a carriage mounting said recording head thereon, the direction of wiping of said blade is only one direction.

In addition, it is an object of the present invention to provide an ink jet recording apparatus having first moving means for moving a flexible blade in its received position to a cleaning position to clean the front surface of a recording head, carriage moving means for moving a carriage mounting said recording head thereon in one direction to clean said recording head when said blade is in the cleaning position, and second moving means for moving said blade from the cleaning position to said received position when the carriage is moved in a direction opposite to said one direction.

It is also an object of the present invention to provide a method of cleaning an ink jet recording head characterized in that when the front surface of said recording head is to be wiped by a flexible blade with the aid of the movement of a carriage mounting said recording head thereon, said blade is wiped by the movement of said carriage, whereafter the front surface of said recording head is wiped by said blade.

In addition, it is an object of the present invention to provide an ink jet recording apparatus having a recording head for discharging liquid and forming flying liquid droplets, a carriage having said recording head mounted thereon, a flexible blade for cleaning the surface of said recording head in which a discharge port is disposed, and a cleaning member provided to clean said blade.

It is another object of the present invention to provide an ink jet recording apparatus characterized by a flexible blade, a movable carriage mounting a recording head thereon, means for moving said carriage and causing said flexible blade to wipe the front surface of said recording head, and means for effecting pre-discharging or pre-heating of ink by electro-thermal energy converting members provided in said recording head after the front surface of said recording head is wiped.

It is still another object of the present invention to provide an ink jet recording apparatus having a recording head, a flexible blade, ink discharge recovery means, and operation control means for controlling both of the operation for cleaning the front surface of said recording head by said flexible blade and the ink discharge recovery operation by said ink discharge recovery means.

DESCRIPTION OF THE PREFERRED EMBODIMENT

The invention will hereinafter be specifically described with reference to the drawings.

Figure 1:
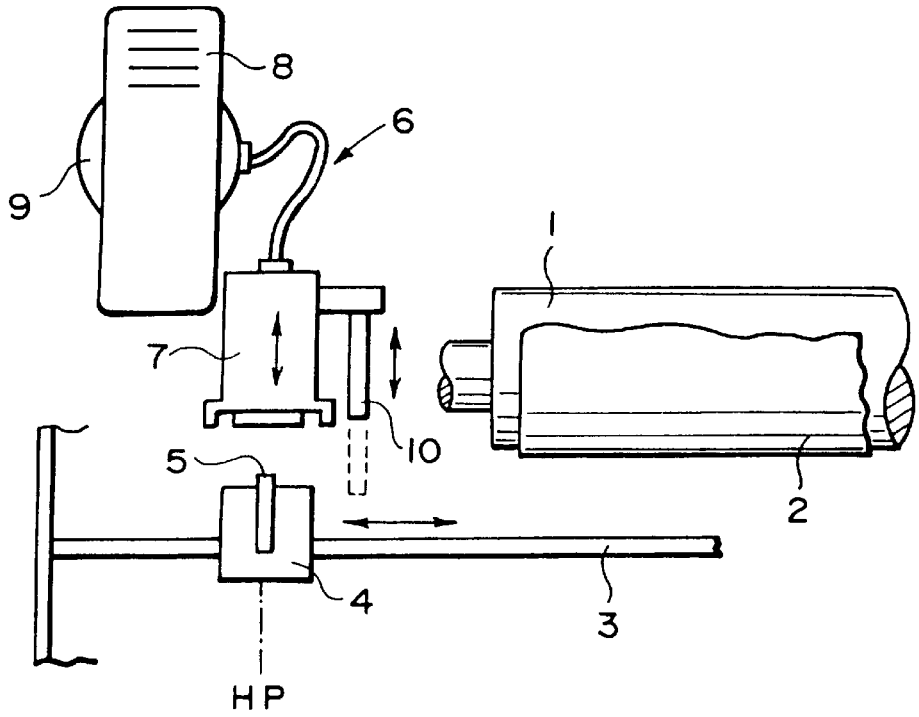
FIGS. 1 and 3 are schematic plan views showing the essential portions of an ink jet recording apparatus according to an embodiment of the present invention.

FIG. 1 shows the construction of the essential portions of an ink jet recording apparatus according to an embodiment of the present invention.

Referring to FIG. 1, a guide shaft 3 is installed forwardly of recording paper 2 backed up by a platen 1, and a recording head 5 movable along the guide shaft is mounted on a carriage 4.

An ink discharge recovery device 6 (which, in the example shown, is of the pump suction type) is provided at the home position HP of the carriage (at the left side of the platen 1 as viewed in FIG. 1). The ink discharge recovery device 6 is provided with capping means 7 driven forwardly and backwardly relative to the recording head 5 and hermetically sealing the front surface of the recording head (the surface formed with an ink discharge port) at the forwardly moved position, and a pump 9 driven by a suction operation lever 8 and sucking ink from the discharge port through capping means 7.

A flexible blade 10 for wiping the front surface of the recording head 5 is mounted on a side (the right side as viewed in FIG. 1) of the capping means 7. This blade 10 is moved forwardly with the forward movement of the capping means 7 which is accomplished by transmitting the drive of a motor or the like thereto by the use of a cam or the like, and during the backward movement of the capping means, it is mounted on the capping means by a mechanism adapted to be left restrained at its forwardly moved position. The backward movement of the blade 10 may be accomplished by releasing the restrained state by the movement of the carriage 4 when the carriage passes from right to left.

Figure 2:
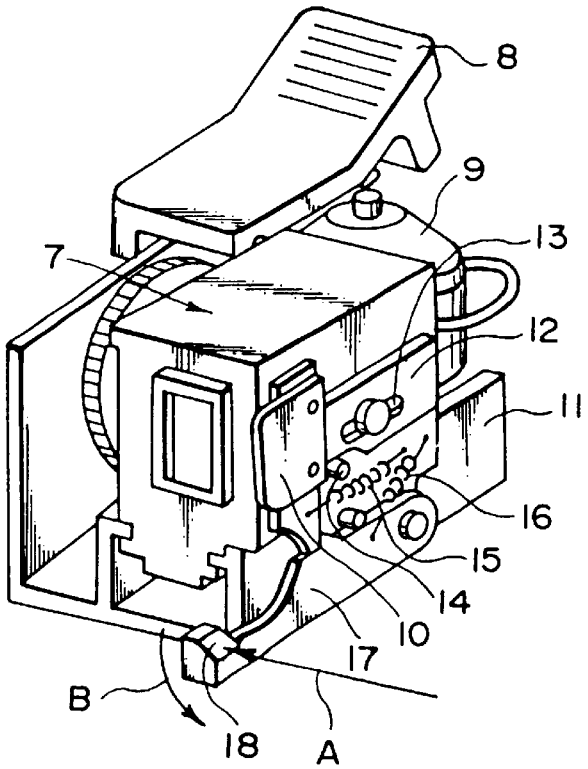
FIG. 2 is a perspective view of the ink discharge recovery device of FIG. 1.

FIG. 2 illustrates the structure of the ink discharge recovery device 6.

Referring to FIG. 2, the suction operation lever 8, the pump 9 driven by depression of the lever 8, and the capping means 7 are supported on a bed 11, and the capping means is supported for forward and backward movement.

A blade supporting plate 12 is mounted on the right side of the capping means 7 while being biased backwardly by means of a slot 13, a stop pin 14 and a backwardly biasing spring 15, and the flexible blade 10 comprising a plastic sheet or a rubber sheet is attached to the fore end portion of the blade supporting plate 12. An engaging member 17, having a pivotable type fitting portion biased to a position engageable with the supporting plate 12 by a spring 16, is attached to the bed 11. This engaging member 17 is adapted to be pivoted (depressed) in the direction of arrow B when the carriage 4 (or the projection thereof) strikes against the inclined surface at the end of the engaging member 17.

A switch (not shown) is connected to the suction operation lever 8, and the circuit construction is such that the switch is closed by the suction operation lever 8 being once depressed and when this is detected, the wiping of the recording head 5 by the blade 10 is effected and the normal ink discharge recovery operation is effected by the suction operation lever being depressed once more.

The operation of the above-described construction will now be described with reference to FIG. 1.

When the carriage 4 is moved from right to left and comes to the home position HP, the capping means 7 moves forward and closes the front of the recording head 5. That is, the cap closing operation is automatically effected. At this time, the blade 10 also moves forward.

The suction operation lever 8 is then pushed to effect an ink discharge recovery operation (an ink suction operation) and, when the ink suction operation is completed, the capping means 7 moves backward. At this time, the blade 10 is still left in its forwardly moved position.

The carriage 4 is then moved leftwardly from the home position HP and at this time, the engaging member 17 (FIG. 2) is depressed and the blade 10 moves backward.

The carriage 4 is then moved rightwardly from its leftmost position and passes the home position HP and is stopped at a position spaced rightwardly from the home position by a predetermined distance.

Thereupon, the capping means 7 is moved forwardly to thereby move the blade 10 forward, and then the capping means is moved backwardly. At this time, the blade 10 is left in its forwardly moved position.

Subsequently, the carriage 4 is moved leftwardly and driven to its leftmost position past the home position HP. In this case, before the carriage arrives at the home position HP, the front surface of the recording head 5, i.e., the surface thereof provided with an ink discharge port, is first wiped by the blade 10 to clean the discharging surface, and then the carriage 4 or the projection thereof strikes against the engaging member 17 (FIG. 2) to move the blade 10 backward while the carriage is further moved leftwardly from the home position HP.

Thereafter, the carriage 4 is moved rightwardly and in the ordinary case, test print is effected and subsequently, an ordinary printing operation in which printing is started by a printing signal is effected.

According to the embodiment described above, the blade 10 is driven forwardly and backwardly by the movement of the capping means 7 and the movement of the carriage 4 and the front surface of the recording head 5 is wiped by the blade utilizing the movement of the carriage 4, and therefore no drive source for exclusive use is required but the cleaning of the ink discharge port surface by the blade 10 can be accomplished by the utilization of the existing mechanism.

Thus, the device for wiping the recording head 5 can be inexpensively constructed by a very simple and compact mechanism.

In the foregoing description, the wiping by the blade 10 has been effected once, but if required, a sequence in which the wiping is repeated twice or more often can be freely carried out.

Also, the direction in which the front surface of the recording head is wiped by the blade 10 may be set to only a direction in which the carriage 4 is moved leftwardly, namely, one direction.

Again in this case, the carriage 4 is moved rightwardly after the completion of the cleaning by the blade 10, and in the ordinary case, test print is effected and subsequently, a normal printing operation in which printing is started by a printing signal is effected.

Usually, in the printing operation from the capped condition, the carriage 4 is moved leftwardly and the blade 10 is moved backwardly, whereafter printing is effected and therefore, the recording head 5 does not contact the blade 10.

As described above, design is made such that the front surface of the recording head 5 can be wiped by the blade 10 only when the carriage 4 is moved from right to left, whereby the direction in which the front surface of the recording head is wiped by the blade 10 is set to one direction and therefore, it never happens that, as in the prior art, the dust pushed away in one direction is forced into the ink discharge port while it is again pushed away in the other direction, and thus, cleaning of the ink discharge port can be reliably accomplished.

In the foregoing description, the wiping operation of the blade 10 has been completed by one operation, but again in the case of the cleaning in one direction, if required, the wiping operation can be freely set to twice or a greater desired frequency by suitably modifying the sequence.

Also, in the embodiment shown, the blade 10 is driven forwardly and backwardly when the ink discharge port surface is wiped, but alternatively, design may be such that the recording head 5 is driven forwardly and backwardly.

Further, the wiping operation by the blade may be effected at any time independently of the capping operation.

In the present invention, when the front surface (the ink discharge port surface) of the recording head 5 is to be wiped, the blade 10 may first be wiped by the movement of the carriage 4, whereafter the front surface of the recording head may be wiped by the blade 10.

Figure 3:
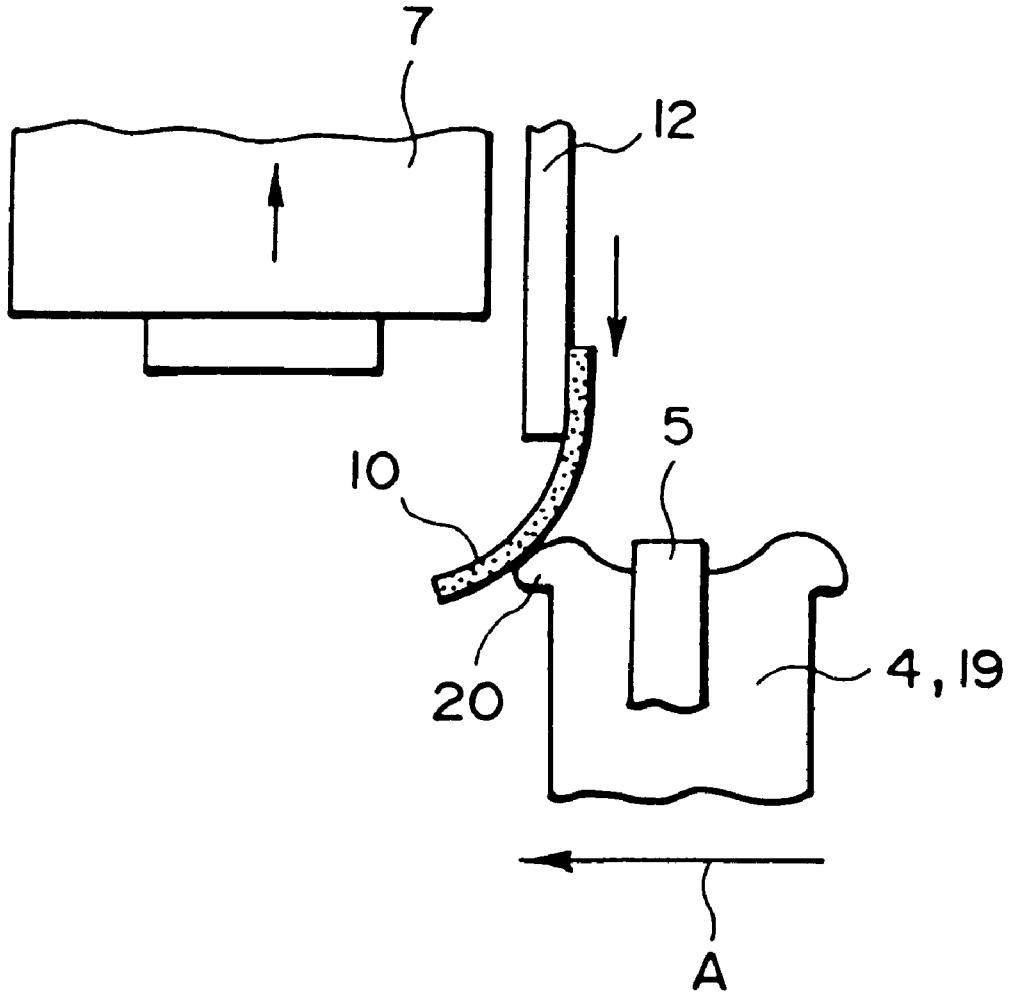

FIG. 3 shows a state in which the blade 10 is wiped by the movement of the carriage 4.

In this state, as previously described, the capping means 7 is in its backwardly moved position and the blade 10 is in its forwardly moved position.

On the opposite sides (or only on the left side as viewed in FIG. 3) of the recording head 5, there are provided protrusions 20 which utilize a portion of the carriage 4 or of a head holder 19 holding the recording head to slidably contact and wipe the blade 10 by movement of the carriage 4 (in the direction of arrow A).

Thus, by movement of the carriage 4, the protrusion 20 wipes and clean the surface of the blade 10, whereafter the blade wipes the front surface of the recording head 5, namely, the surface thereof formed with an ink discharge port.

The portion of the carriage 4 for wiping the blade 10 which portion corresponds to the protrusion may be provided at any other location on the carriage 4 than the surface formed with the ink discharge port.

According to the embodiment described above, even if any special mechanism for cleaning the blade 10 is not provided, the blade 10 can be cleaned by the utilization of the movement of the carriage 4.

Also, the blade 10 can be cleaned without fail before the recording head 5 is wiped and therefore, the ink discharge port can always be cleaned effectively.

Further, any special sequence for cleaning the blade 10 is not required, but cleaning of the blade 10 can be realized simply by providing the protrusions (the sliding contact portions) 20 on the carriage side.

In the embodiment shown, description has been made of a case where the front surface of the recording head 5 is wiped only when the carriage 4 is moved from right to left, that is, only from one direction, but the present invention is equally applicable also to the case of cleaning means of the type which wipes the recording head 5 from the opposite direction or from both directions.

Description will hereinafter be made by taking as the recording head 5 an example using a system wherein a plurality of electro-thermal energy converting members (heat generating elements) corresponding to a plurality of ink discharge ports are driven on the basis of a printing signal and the generated heat energy is utilized to form flying ink droplets. In the recording head 5, in addition to the electro-thermal energy converting members for printing drive as mentioned previously, there are provided in some cases electro-thermal energy converting members (preheating heaters or the like) for heating the atmospheric temperature to bring about a printable condition when the atmospheric temperature is low and viscosity of ink is high, and the electro-thermal energy converting members in the present invention refer to one or both of these energy converting members.

Figure 4:
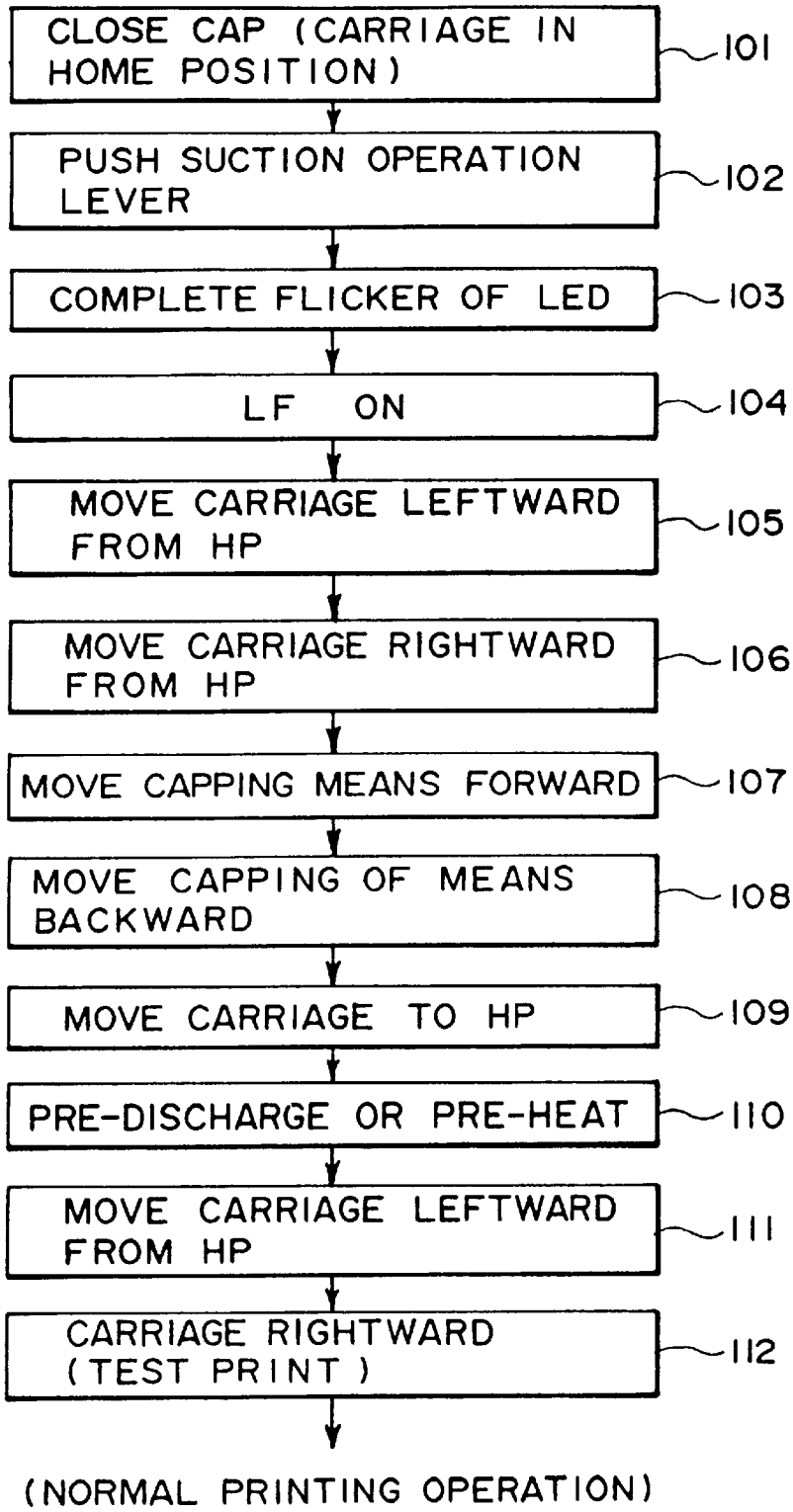
FIG. 4 is a flow chart showing an example of the operation sequence of the apparatus of FIG. 1.
Figure 5:
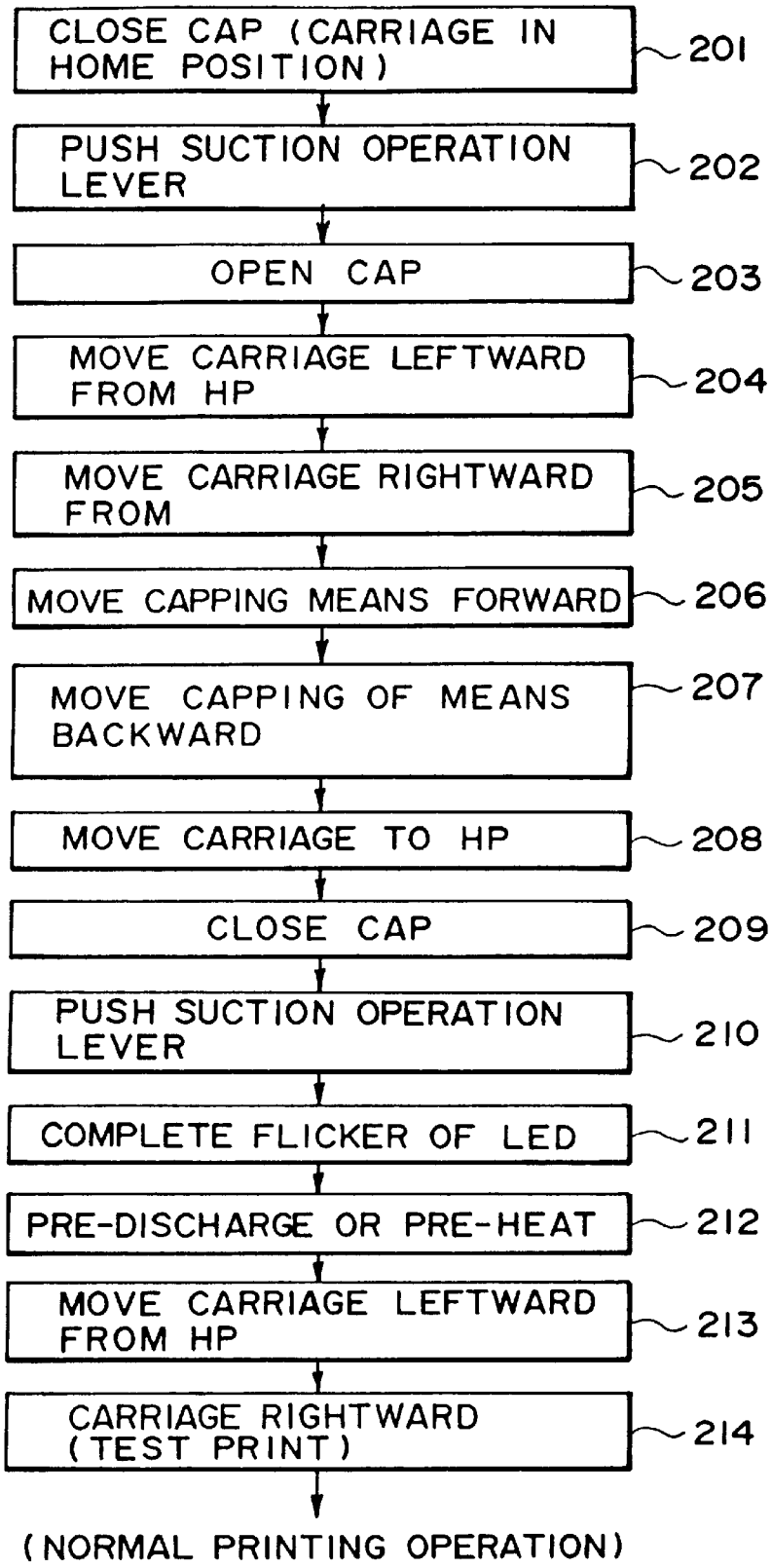
FIG. 5 is a flow chart showing another example of the operation sequence of the apparatus of FIG. 1.

FIGS. 4 and 5 are flow charts illustrating the sequence of the blade wiping operation by the operation control means of the above-described ink jet recording apparatus.

The sequence of FIG. 4 will first be described with reference to FIGS. 1 and 2.

Step 101: The carriage 4 is moved from right to left and arrives at the home position HP, whereupon the movement thereof is stopped and then the capping means 7 is moved forwardly and closes the front surface (ink discharge port surface) of the recording head 5. At this time, the blade 10 is also moved forward. (The carriage is in the home position.)

Step 102: The suction operation lever 8 of the discharge recovery device is pushed to thereby effect the ink discharge recovery operation. At the same time, the contact making for effecting the wiping operation by the blade is effected by the lever 8. (For example, the pressure force thereof is detected by a switch and the contact making is effected.) (The carriage is in the home position.)

Step 103: When the suction operation is completed, the flicker of LED as an operation signal is completed and the capping means 7 is moved backwardly. The blade 10 is left in its forwardly moved position by the leaving mechanism. (The carriage is in the home position.)

Step 104: Subsequently to the contact making at step 102, LF (line feed) switch is closed.

Step 105: The carriage 4 is moved leftwardly from the home position HP, whereby the engaging member 17 is depressed and the blade 10 is moved backwardly. (The carriage is at the left of the home position.)

Step 106: The carriage is moved rightwardly and is stopped at a position spaced rightwardly from the home position by a predetermined distance. (Since the blade is moved backwardly, the wiping (cleaning) operation by the blade is not performed.)

Step 107: The capping means 7 is moved forwardly, whereby the blade 10 is also moved forwardly. (Since the carriage is at the right of the home position, the front of the recording head 5 is not closed.)

Step 108: The capping means 7 is moved backwardly. The blade 10 is left at its forwardly moved position by the leaving mechanism. (The carriage is at the right of the home position.)

Step 109: The carriage 4 is moved leftwardly to the home position. The front surface of the recording head 5 is wiped by the blade 10 while the carriage is thus moved. (The blade is moving forward.)

Step 110: The electro-thermal energy converting members provided in the recording head 5 are driven by transmitting a signal processed in control means 35 in accordance with a pre-discharge signal 33 or a pre-heat signal 34 through flexible wiring 36 to effect the pre-discharging or pre-heating of the ink in the vicinity of the ink discharge ports, thereby reducing the viscosity of the ink near the ink discharge ports. (The carriage is in its home position and the blade is in its forwardly moved position.)

Step 111: The carriage 4 is moved leftwardly from the home position HP, whereby the engaging member 17 is depressed and the blade 10 is moved backwardly. (The carriage is at the left of the home position.)

Step 112: The carriage 4 is moved to the right printing starting position and test print is effected. By this time, the blade 10 has already been moved backwardly and therefore, the front surface of the recording head 5 is not wiped by the blade 10.

Thereafter, the normal printing operation based on a printing signal is started.

At step 104, the LF switch may be replaced by other switch which need not be a special external switch. This step is not always necessary if a recording member is already prepared or if a pre-discharge position is provided discretely.

Further, normal printing may be effected on the basis of a printing command without the test print of step 112 being effected.

According to the above-described embodiment, the wiping of the ink discharge port surface of the recording head 5 by the blade 10 is carried out within the operation sequence of the ink discharge recovery operation and the operation of these is effected in a series by the contact making which starts the ink discharge recovery operation and therefore, the wiping operation and the control system therefor can be much simplified. Also, the influence upon the ink discharge ports can be reduced.

Furthermore, the wiping operation of the blade is accomplished by the utilization of the movement of the carriage 4, and this eliminates the necessity of providing a special drive source, which in turn leads to the provision of simple and inexpensive ink discharge port cleaning means.

The sequence of FIG. 5 of the control means will now be described with reference to FIGS. 1 and 2.

Step 201: When the carriage 4 is moved from right (for example, the printing area or the printing starting position) to left and arrives at the home position HP, this movement is stopped, and then the capping means 7 moves forward and closes the front (ink discharge ports) of the recording head 5. At this time, the blade 10 also moves forward with the capping means 7.

Step 202: The suction operation lever 8 is pushed to effect the ink discharge recovery operation and the switch is closed (the first contact making), and the contact making is detected, whereby starting a series of operations for wiping the front surface of the recording head 5, i.e., the surface formed with the discharge ports, by the blade 10.

Step 203: The capping means 7 is moved backwardly from the recording head 5 to open the cap. At this time, the blade 10 is left in its forwardly moved position. The carriage is in its home position.

Step 204: The carriage 4 is moved leftwardly from the home position HP to thereby depress the engaging member 17, thus moving the blade 10 backward.

Step 205: The carriage is moved rightwardly from its leftmost position and passes the home position HP and is stopped at the right thereof. Since the blade 10 has already been moved backwardly, the front surface of the recording head 5 is not wiped.

Step 206: The capping means 7 is moved forwardly and the blade 10 is also moved forwardly. The carriage is not moved from the right of the home position.

Step 207: The capping means 7 is moved backwardly. The blade 10 is left in its forwardly moved position by the leaving mechanism.

Step 208: The carriage 4 is moved leftwardly to the home position HP, whereby the ink discharge port surface of the recording head 5 is wiped by the blade 10 (blade cleaning).

Step 209: The capping means 7 is moved forwardly and closes the ink discharge port surface of the recording head which is now in the home position.

Step 210: The suction operation lever 8 is pushed to effect the second contact making (the contact making for the ink discharge recovery operation).

Step 211: The ink suction operation from the ink discharge ports is completed and the flicker of LED as the operating signal for the suction operation is completed.

Step 212: The electro-thermal energy converting members of the recording head 5 are driven by transmitting a signal processed in control means 35 in accordance with a pre-discharge signal 33 or a pre-heat signal 34 through flexible wiring 36 to effect the pre-discharging or pre-heating of the ink in the vicinity of the ink discharge ports for reducing the viscosity of the ink, whereafter the capping means 7 is moved backwardly and the cap becomes open. At this time, the blade 10 is left in its forwardly moved position by the leaving mechanism.

Step 213: The carriage 4 is moved leftwardly from the home position HP to thereby depress the engaging member 17 and move the blade 10 backward.

Step 214: The carriage 4 is moved to the printing starting position or the printing capable position, whereupon test print is effected. By this time, the blade 10 has already been moved backwardly and therefore, the wiping of the recording head 5 does not take place.

Thereafter, the normal printing operation is started on the basis of a printing signal.

According to each embodiment described above, the ink discharge port surface (the front surface of the recording head 5, is wiped by the blade 10, where-after pre-discharging or pre-heating of the ink discharge ports is effected by the heating means provided in the recording head and therefore, even if ink of increased viscosity adheres to the ink discharge ports when wiped by the blade, the recording head 5 can be heated to pre-discharge the ink of increased viscosity by the pre-discharging or reduce the viscosity of the ink to a proper value by the pre-heating and thus, it becomes possible to secure normal printing operation.

Also, the above-described operation can be carried out simply by the utilization of the existing heating means and therefore, it is not necessary to provide a new mechanism and proper viscosity of the ink can be realized by only modifiying a part of the sequence and by a very simple and inexpensive construction.

The present invention can be freely carried out in a suitable sequence as defined in the appended claims even if the operation control means and the sequence of the control means are other than those described above.

According to the present invention, as described above, there can be provided an ink jet recording apparatus which does not require a drive source for exclusive use and in which the front surface of the recording head, i.e., the ink discharge port surface, can be wiped by a minimum mechanism.

Also, according to the present invention, there can be provided an ink jet recording apparatus which uses the actuating (contact-making) means of the ink discharge recovery device and can execute the cleaning of the ink discharge port surface and the ink discharge recovery operation in a series of sequence and which permits omission of individual driving systems.

Further, according to the present invention, there can be provided an ink jet recording apparatus in which the ink discharge port surface can be cleaned by a simple operation and the ink discharging capability can be maintained normal.

Furthermore, according to the present invention, there can be provided an ink jet recording apparatus and a cleaning method which do not require any new cleaning mechanism and any special sequence or the like and in which the ink discharge port surface can be wiped always by a clean blade.

In addition, according to the present invention, there can be provided an ink jet recording apparatus and a cleaning method which can solve the problems peculiar to the prior art and in which the direction of wiping by the blade is set to one direction, whereby dust is not forced into the ink discharge ports and cleaning of the ink discharge port surface can be accomplished reliably.

What is claimed is:

1. A recording method using an ink jet recording head for scanning between a recording area and a non-recording area and for discharging ink to record an image on a recording medium at said recording area, the method comprising the steps of:

wiping a discharge surface of said ink jet recording head;

preliminarily discharging ink from said recording head after said wiping step by using an energy generating element of said recording head;

performing a test print by moving said ink jet recording head to a record start position or a recordable position of said recording area after said preliminary discharging step and then causing said ink jet recording head to discharge ink on the recording medium; and performing normal recording in response to a recording signal after said test print performing step.

2. A recording method as in claim 1, wherein said recording head discharges ink using thermal energy generated by an electro-thermal converting element.

3. A recording method using an ink jet recording head for scanning between a recording area and a non-recording area and for discharging ink to record an image on a recording medium at said recording area, the method comprising the steps of:

wiping a discharge surface of said ink jet recording head;

preliminarily heating said recording head after said wiping step;

performing a test print by moving said ink jet recording head to a record start position or a recordable position of said recording area after said preliminary heating step and then causing said ink jet recording head to discharge ink on the recording medium; and performing normal recording in response to a recording signal after said test print performing step.

4. A recording method as in claim 3, wherein said recording head discharges ink using thermal energy generated by an electro-thermal converting element.

5. A recording method as in claim 4, wherein said preliminary heating step is performed by actuating a separate second electro-thermal converting element.

6. A recording method using an ink jet recording head for scanning between a recording area and a non-recording area and for discharging ink to record an image on a recording medium at said recording area, the method comprising the steps of:

wiping a discharge surface of said ink jet recording head;

preliminarily discharging ink from said recording head after said wiping step; and, without wiping said discharge surface of said ink jet recording head after said preliminary discharging step, performing normal recording in response to a recording signal.

7. A recording method as in claim 6, wherein said recording head discharges ink using thermal energy generated by an electro-thermal converting element.

8. A recording method using an ink jet recording head for scanning between a recording area and a non-recording area and for discharging ink to record an image on a recording medium at said recording area, the method comprising the steps of:

wiping a discharge surface of said ink jet recording head;

reducing a viscosity of ink adhered to said discharge surface or adhered to discharge ports of said ink recording jet head by heating said recording head after said wiping step; and, without wiping said discharge surface of said ink jet recording head after said preliminary heating step, performing normal recording in response to a recording signal.

9. A recording method as in claim 8, wherein said recording head discharges ink using thermal energy generated by an electro-thermal converting element.

10. A recording method as in claim 9, wherein said preliminary heating step is performed by actuating a separate second electro-thermal converting element.

* * * * *